US007228581B2

(12) United States Patent
Mezue

(10) Patent No.: US 7,228,581 B2
(45) Date of Patent: Jun. 12, 2007

(54) INFLATABLE SEX SUPPORT UNIT FOR MATTRESS

(76) Inventor: Arthur Mezue, 119 Scotchpine Dr., Islandia, NY (US) 11749

( * ) Notice: Subject to any disclaimer, the term of this patent is extended or adjusted under 35 U.S.C. 154(b) by 0 days.

(21) Appl. No.: 11/317,925

(22) Filed: Dec. 24, 2005

(65) Prior Publication Data

US 2006/0162084 A1 Jul. 27, 2006

(51) Int. Cl.
*A47C 27/08* (2006.01)

(52) U.S. Cl. ..... 5/713; 5/715; 5/691; 5/694; 5/731; 128/845

(58) Field of Classification Search ..... 5/630, 5/632–634, 615, 648, 652, 655.3, 691, 660, 5/731–735, 929
See application file for complete search history.

(56) References Cited

U.S. PATENT DOCUMENTS 2,769,182 A 11/1956 Nunlist
3,161,219 A 12/1964 Danhi
3,392,412 A 7/1968 Aymar
3,667,075 A 6/1972 Ballard et al.
3,843,980 A * 10/1974 Rodriguez ..... 5/733
3,896,787 A * 7/1975 Withers ..... 128/845
3,935,604 A * 2/1976 Collins ..... 5/630
4,941,221 A * 7/1990 Kanzler ..... 5/615
5,092,007 A * 3/1992 Hasty ..... 5/715
5,170,522 A 12/1992 Walker
6,012,186 A 1/2000 Soltani et al.
6,085,372 A * 7/2000 James et al. ..... 5/713
6,298,511 B1 * 10/2001 Collymore ..... 5/715
6,311,348 B1 11/2001 Luff et al.
6,834,651 B1 * 12/2004 Murdock et al. ..... 128/845
6,874,180 B2 * 4/2005 Liao ..... 5/486
6,886,204 B2 * 5/2005 Kasatshko et al. ..... 5/722

* cited by examiner

*Primary Examiner*—Michael Trettel

(57) ABSTRACT

An inflatable sex-support unit for mattress configured to be temporarily or permanently attachable to such mattress, comprising of bladders that are stowed away in layers of bedspread and foams, that inflate to a height of 12 or more inches above the unit's surface to elevate and support the back area including the buttocks; to elevate and support the left leg in a wide spread posture; to elevate and support the right leg in a wide spread posture; while leaving enough space between the two lower bladders for a second party to occupy during sexual intercourse. The top area provides a soft and smooth surface that is also utilized for sleeping atop such bed or on the ground surface.

20 Claims, 5 Drawing Sheets

INFLATABLE SEX SUPPORT UNIT FOR MATTRESS

FIELD OF THE INVENTION

The present invention relates generally to a mattress/mattress pad system, and more importantly to inflatable sex support unit configured with a plurality of bladders that are stowed away in layers of bedspread, which is detachably attachable by means of sewing, zipper or Velcro, to the surface area of the mattress, to inflate by means of an air pump to height of 12 or more inches above the unit's surface into shapes and sizes that aid sexual intercourse. The surface area is padded with soft materials and a bedspread that will also be utilized for sleeping atop the mattress, ground surface or other solid surfaces

BACKGROUND OF THE INVENTION the present invention which is configurable/attachable onto a mattress, offers flexibility during sexual intercourse, for the young, the old, and the sick, that may experience discomfort while suspending their legs for a long period of time during sex. It is also for people with back, knee, or leg pains that have difficulty in having sex without excruciating aches and pains. Some couples will like to vary the ways they have sex, such people have tended to move from couches to tables in a bid to improve their sex life. The present invention is about accomplishing the above needs by inflating the bladders that are strategically stowed away in some layers of foam and fabric to achieve comparable sexual positions obtainable in such other areas without leaving the comfort of your bed. The invention is attachable by sewing or zipper directly to the surface area of the mattress to constitute a substitute for such surface or configured to be removably attachable to the mattress.

U.S. Pat. Nos. 2,769,182, 3,161,219, 3,392,412, 3,667,075, 5,170,522, 6,012,186, 6,311,348, discloses inflatable bladders and bellows that are placed under the mattress to raise the head and foot section for reading or relaxation. The aforementioned patents discussed inflatable bladders that support the head and the feet by forming an incline in both areas. Also most of the prior arts discussed independent units that are placed under a mattress which utilizes a motor or a microprocessor based hand control for their inflation and deflation with the sole aim of being utilized for relaxation.

But however nothing is disclosed or suggested in this patents about an inflatable bedding product that is either detachably attachable or directly configurable atop a mattress, covering all or part of mattress. The present invention consists of three or more of independent bladders of any shape and size, that are stowed away in layer of foams and fabrics, that inflates to a height of 12 inches or more above the units surface to fully elevate the upper half of the body including the buttocks area; independently elevate the lower portion of the left leg and thigh in a wide spread posture; independently elevate the lower portion of the right leg and thigh in a wide spread posture, while leaving enough space between the two lower bladders for a second party to occupy during sex. The present invention attaches to a mattress to look like the bedspread, while hiding the bladders inside the unit to provide privacy of purpose, thereby eliminating the need to hide bulky sex foams or other sex devices from the prying eyes of children.

Therefore, the present invention is about reducing the aches and rigors involved in sexual intercourse, and providing couples the flexibility of adjusting to different sexual position by a mere push of a button or switch without leaving the comfort of their bed. It will also reduce the strain of suspending legs during sex by forming a cushion for them.

SUMMARY OF THE INVENTION

In view of the foregoing disadvantages inherent in the above-mentioned prior art, the general purpose of the present invention is to provide a medium that will support sexual intercourse and provide various angles and positions for such process. It utilizes a plurality of bladders and together with inflation means to route air to the bladders independently, simultaneously or in other combinations, for sex support. It also consists of three or more bladders; foam configured with three rectangular shallow craters for the bladders; top cover with three full cavities; layers of sewn fabric; air pump; air control box, a manual switch or wired/wireless remote control with LCD screen and LED indicators.

In one aspect, inflatable sex-support unit, sized to cover all or some areas of the mattress, comprising of a bottom unit and a top cover which are configured with three rectangular shallow crater that will dock the bladders and three full cavities that will provide safe passage for such bladders that are stowed away in the unit.

in another aspect, the bladders are connected by means of tubes or hoses to an air pump that utilizes three air outlet holes or to an air control box that utilizes a manual or mechanical process in selectively routing air to desired bladders. It utilizes a hand control unit to manipulate by means of a chip/microprocessor method (known in the art), the air pressure in the bladders automatically or by manual process, using a programmable or non programmable means. The inflatable sex-support unit utilizes dual lock, auto lock or spin lock system for the valve and in instances when a remote unit is used, it will have a preset limit above which the pump will not exceed thereby eliminating any fear of over inflation. When fully assembled, by selecting a desired position via the hand held unit or the air control box and pushing the inflate button, the air pump will be activated, and the required outlet valve will release air into the selected bladders to inflate them to desired height and shape for sex.

These, together with other objects of the invention, along with various features of novelty that characterize the invention, are pointed out with particularity in the claims annexed hereto and form a part of this disclosure. For a better understanding of the invention, its operating advantages, and the specific objects attained by its uses, the accompanying drawings and descriptive matter in which there are illustrated exemplary embodiments of the invention should be referred to.

BRIEF DESCRIPTION OF THE DRAWINGS for a better understanding of the nature of the present invention, reference should be made to the detailed description taken in conjunction with the accompanying drawings in which.

like reference numerals refer to like part throughout the several views of the drawings.

Figure 1:
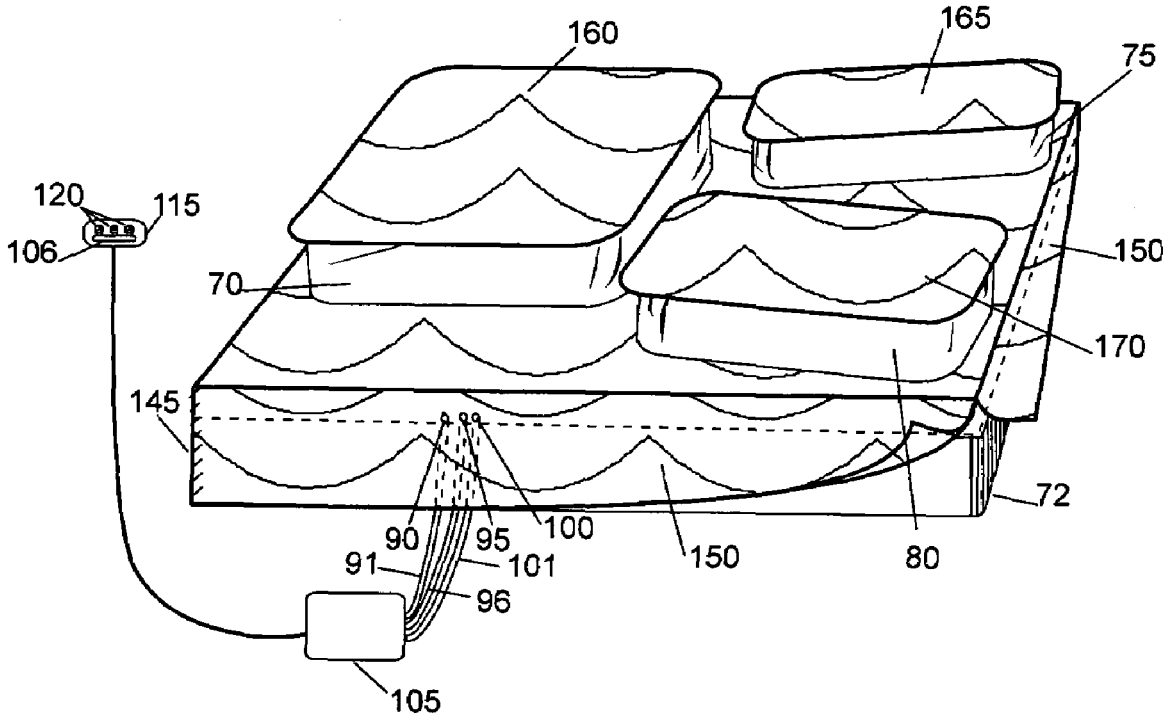
FIG. 1 is a perspective view of the fully assembled and inflated unit, constructed in accordance with the exemplary embodiments of the present invention.

DETAILED DESCRIPTION OF THE INVENTION the exemplary embodiments described herein are detailed for illustrative purposes only and are subject to many variations in structure and design. It should be emphasized, however that the present invention is not limited to a particular number or shape of bladder, air pump, control unit or method of assembly, the principles of the present invention can be used with a variety of sleep support unit's. The configurations and structural arrangements could include a permanent attachment of the unit to air, foam, spring or coil mattresses to constitute a substitute for the surface area. It is understood that various omissions, substitutions, and equivalents are contemplated as circumstances may suggest or render expedient, but it is intended to cover the application or implementation without departing from the spirit or scope of the claims of the present invention.

The present invention provides the flexibility of adjusting to different position and angle for sexual intercourse through the inflation of bladders embedded in a sewn or heat sealed product, while supporting to the thigh and legs of a person lying atop the unit.

the present invention provides maximum support to the hips, the stomach and the upper half of the body when the upper half bladder is in a square, circular, wedge or ramp shape. It contours onto the body absorbing the excess pressure exerted during sex and allows a female partner to select the height at which clitoral stimulation is maximized.

Exemplary embodiments of the present invention will now be described with reference to the accompanying drawings. The structure and system of the present invention will now be described with reference to FIGS. 1-8C, the present invention comprises of a top cover FIG. 4 and the bottom unit FIG. 3, A foam 5, mid area split 10, upper half rectangular shallow crater 20, the lower left rectangular shallow crater 25, the lower right rectangular shallow crater 30, upper bladder attachment Velcro 35, the lower left bladder attachment Velcro 40, lower right bladder attachment Velcro 45, upper tube channel 50, lower left tube channel 55, lower right tube channel 60, upper bladder 70, lower left bladder 75, lower right bladder 80, bottom unit zipper 85, connecting tube socket for upper bladder 90, connecting tube socket for lower left bladder 95, connecting tube socket for the right bladder 100, upper connection tube 91, lower left connection tube 96, lower right connection tube 101, bottom unit' four corner surface Velcro 190, air pump 105, LCD display 106, pump's three air outlets/inlets (not shown), air control box (not shown), wired/wireless remote control 115, control buttons 120, memory unit (not shown), lower unit's fabric surface 125, top cover's upper half full cavity 130, top cover's lower left full cavity 135, top cover's lower right full cavity 140, mattress securing zippers 145, extended fabric portion 150, the padded fabric surface of the top cover 155, upper half cavity lid 160, lower left cavity lid 165, lower right cavity lid 170, lid attachment Velcro 175, fabric surface lid attachment Velcro 176, mattress 72.

Figure 4:
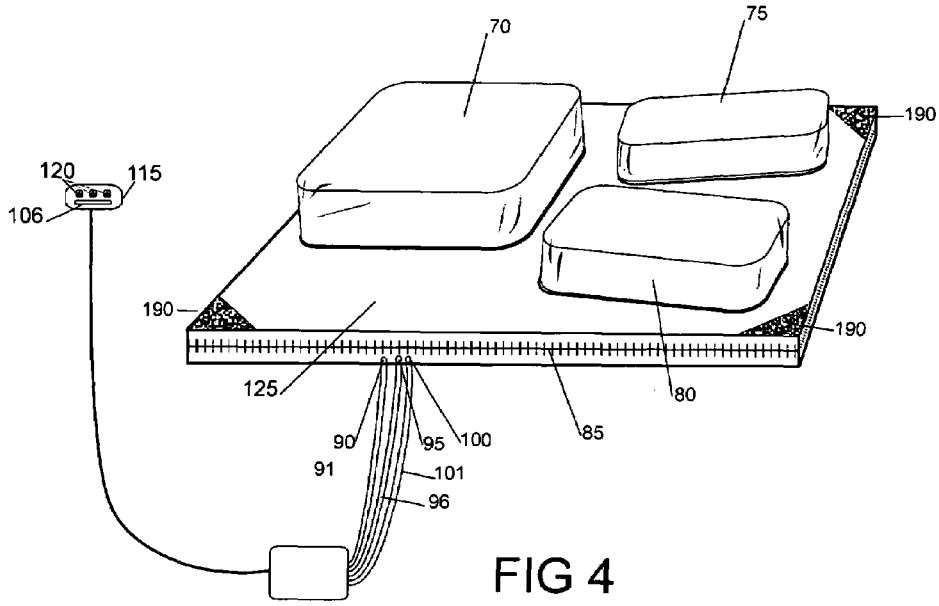
FIG. 4 is view of the bottom unit encased in fabric with inflated bladders and the inflation means; constructed in accordance with the exemplary embodiments of the present invention.
Figure 5:
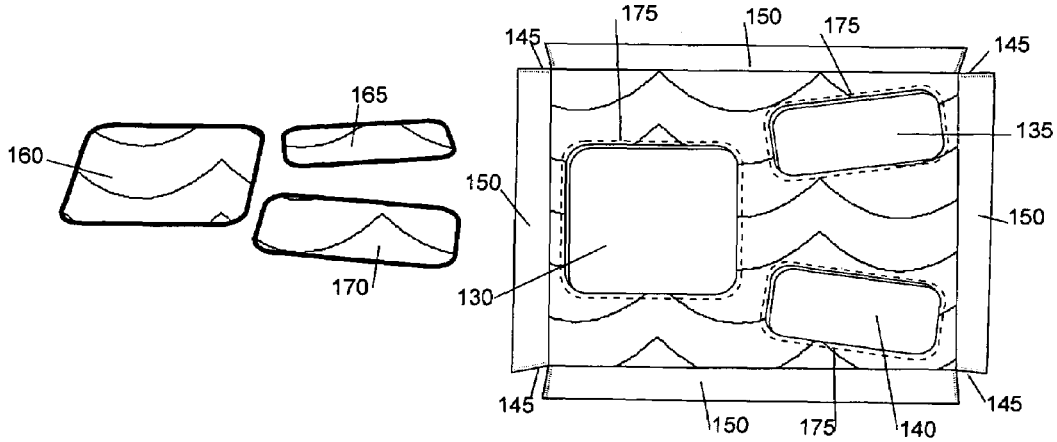
FIG. 5 is a top view of the top cover with the three full cavities and three lids, constructed in accordance with the exemplary embodiments of the present invention.

FIG. 1 is the fully assembled unit consisting of the Top cover FIG. 5, attached to the lower unit FIG. 4 by means of the four corner surface Velcro 190 and Velcro lining on the bottom area of the top cover (not shown), with the top cover FIG. 5 attached to the mattress 72, by means of extended fabric 150 or bed skirt with elastic, and zippers 145. The bottom unit is configured with foam 5, (which could also be used in place of the top surface area of the mattress when unit is configured directly on the mattress) that is one inch or more in thickness, with three rectangular shallow craters 20, 25, 30 that configured to fit into the craters and level off with the surface area of the foam 5, to provide docking spots for bladders 70, 75, 80, the bladders 70, 75, 80, are attached by Velcro lining 35, 40, 45, to ensure that the bladders are flat after deflation. The bottom unit's foam 5, is covered by fabric 125, or any flocked material that extend substantially all around the foam 5, (all fabric used for the unit are configured to be removable and washable) with the craters 20, 25, 30 left uncovered. Four corners of the bottom unit's fabric surface are lined by Velcro 190, this ensures that the top cover FIG. 5 when attached by means of an underlining Velcro (not shown) will be stable and not move to disturb bladders 70, 75, 80 when emerging vertically though the rectangular top cover's full cavities. The rectangular top cover FIG. 5 and the bottom unit FIG. 4 are then mounted atop a mattress 72 and secured by zippers 145, the tubes 91, 96, 101 passes through channels in FIG. 2, 50, 55, 60 to the socket on the side of the unit 90, 95, 100, where they are connected with the other part of the tube 91, 96,101, which is then attached to the inlet three inlet valves (not shown) of pump 105. The remote control 115 comprises of control buttons 120, and an LCD 106, which displays the pressure reading for the bladders, an LED indicator (not shown) and a status adjustment display (not shown). The remote is configured with memory unit (not shown) which store user preferences that could be applied automatically. By programming the wired or wireless remote control 115, and pressing the inflate button, the air pump 105, is activated to release air into the selected bladder or bladders to the pre programmed heights independently or simultaneously or in any combination desired. A manually operable air pump with an air control box that will route air by mechanical or manual means will be used for some of the unit and will utilize an inflate/deflate pump or utilize a manual process of opening the release valve by hand for deflation.

Figure 2:
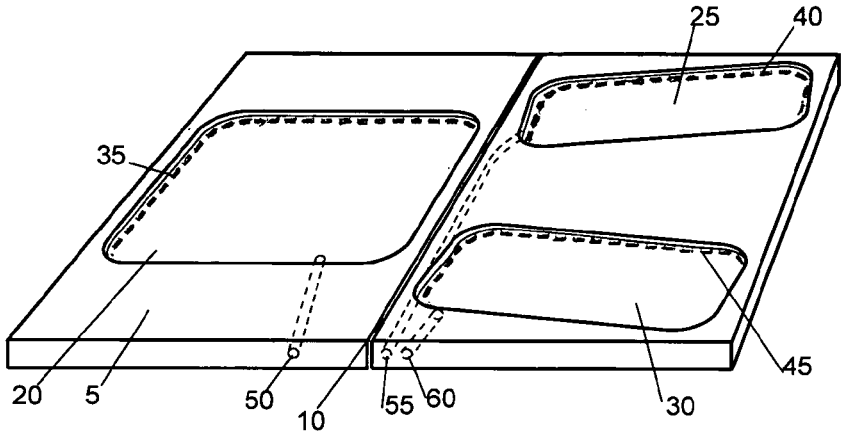
FIG. 2 is a perspective view of the inner foam of the bottom unit configured with three rectangular shallow craters, constructed in accordance with the exemplary embodiments of the present invention.

FIG. 2 is the inner foam of the bottom unit which provides a support structure and a soft feel when unit is utilized on the ground surface. It consists of rectangular foam 5, one inch or more in thickness, sized to fit the mattress 72 atop which it will be used and is split in the mid area 10, for portability with an upper half, a mid area, and a lower half, wherein the upper half can be configured without or with a rectangular shallow crater 20, that will dock the upper bladder 70 and shield a user from discomfort, the bottom of the upper rectangular shallow crater is lined by one arm of Velcro 35, while the bottom of the upper half bladder is 70 is lined by the other arm of Velcro (not shown) for securing them together. The left shallow rectangular crater 25 is lined by a Velcro 40, for securing the left rectangular bladder 75 to the crater 25. The right rectangular shallow crater 30, lined with Velcro 45 for securing the bladder 80 to the crater, the connecting channels 50, 55, 60 is for passing tubes to the air pump and can be configured at any place considered most appropriate by those skilled in the art. The foam 5, can be split into two or more pieces and secured together by means of sewing to make it foldable and highly portable. The connecting tubes 91, 96, 101 split into a first part connecting from the valves of bladders 70, 75, 80 to a side socket 90, 95, 100, while the other half of the tubes are connected to the air pump 105, or an air control box when a switch operated pump is used, this makes it possible to detach the pump 105, and remote 115 and store them when not required.

Figure 3:
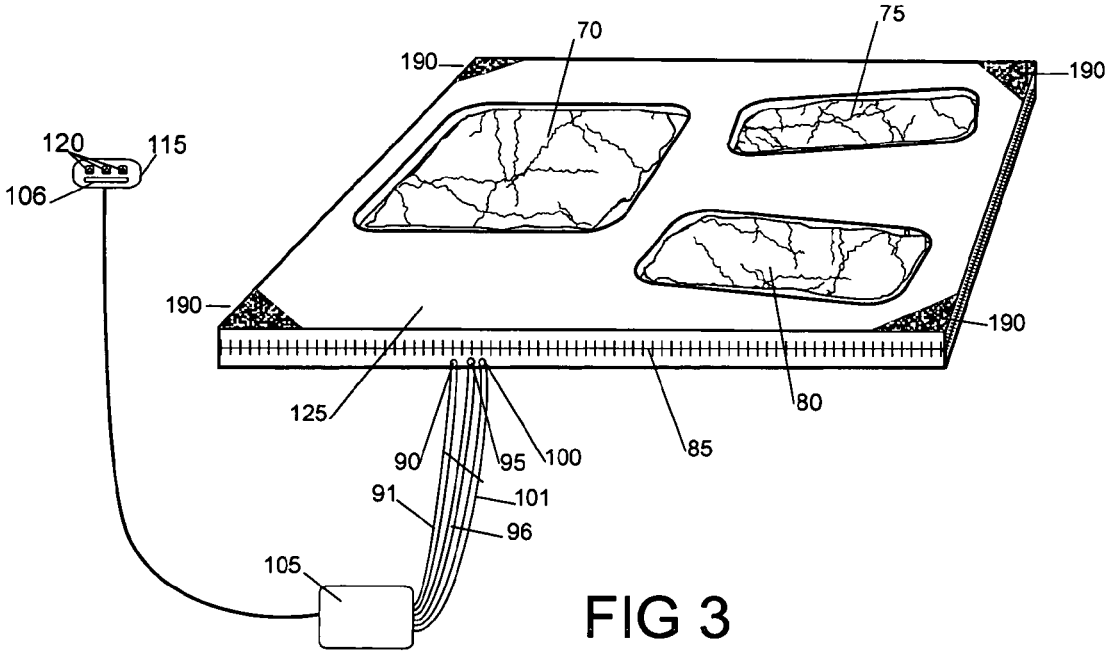
FIG. 3 is the perspective view of fabric covered foam of the bottom unit with attached deflated bladders, constructed in accordance with the exemplary embodiment of the present invention.

In FIG. 3 is the bottom unit of the invention wherein the foam FIG. 1, is encased in fabric 125, and secured by a zipper 126 that runs from the mid side area all round the unit, with the three tubes 91, 96, 101, connecting the air inlet/outlet valves (not shown) of the deflated bladders FIG. 3 70, 75, 80, to the side sockets 90, 95, 100, with the other half of the tube extending from the socket to the air outlet/inlet holes (not shown) of the air pump 105, this is meant to create a unit in which the air pump 105, the remote control 115 and part of the tube 91, 96, 101 can be detached and stored when not in use. The remote control 115 consist of three control buttons 120, an LCD 106 and houses a memory unit (not shown) and a status display pictorial (not shown). The bottom unit FIG. 3 and 4 can be attached to the top cover by the four corners Velcro 190, and to the mattress by means of zipper 145 or Velcro, snaps, buttons, double sided tapes, straps of any form of configuration or cloth skirt with elastic.

In FIG. 4 is the bottom unit comprising of the foam FIG. 1 encased in fabric 125, excepting for areas housing bladders. The top four corners of the fabric are lined by Velcro 190, for attaching the top cover FIG. 5 to the unit. The remote control 115 is used together with the air pump 105 to send air through the outlet/inlet holes (not shown), and through to the tubes 91, 96, 101, into the inlet holes (not shown) of the bladders 70, 75, 80, to inflate them independently, simultaneously or any combination desired. The remote control 115 can display pressure information in each of the bladder independently and simultaneously. The remote control 115 comprises of three control buttons 120 that are used to manipulate air pressure in bladders 70, 75, 80, so that they will inflate to positions and angle for sex while a second party occupies the space between 75 and 80 or other spaces that will depend on inflation combination.

Referring to FIG. 5 is the rectangular top cover, this provides the type of comfort similar or better than what is obtainable on the mattress atop which the unit is mounted. The bottom side of the top cover is lined by Velcro (not shown) for attaching it atop the bottom unit, FIG. 3 and 4 and the four sides have extended fabrics 150, and zippers 145, for attaching to a mattress FIG. 6, the padded fabric surface area 155, is configured with three cavities 130, 135, 140, reaching through to the other side and three lids 160, 165, 170. The edges of the lids are lined by Velcro 176 for securing against the top cover lid Velcro 175. This unit is padded with polyester fill, Visco-elastic foam or such other material that will provide for a smooth and soft surface for sex and sleep.

Figure 6:
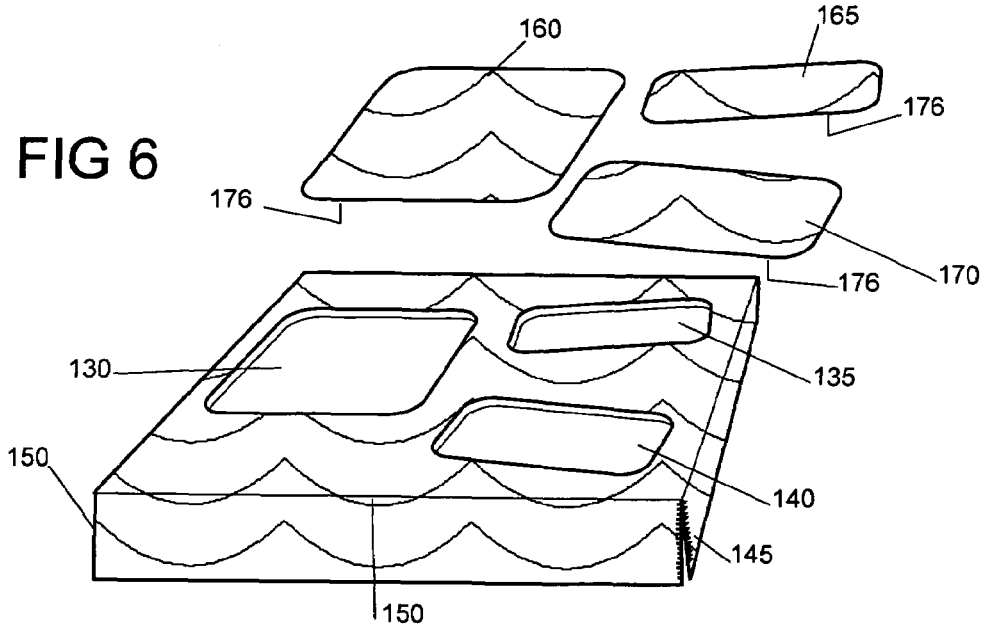
FIG. 6 is a perspective view of the top cover, the three full cavities and the three lids, secured over the bottom unit and mattress, constructed in accordance with the exemplary embodiments of the present invention.
Figure 7:
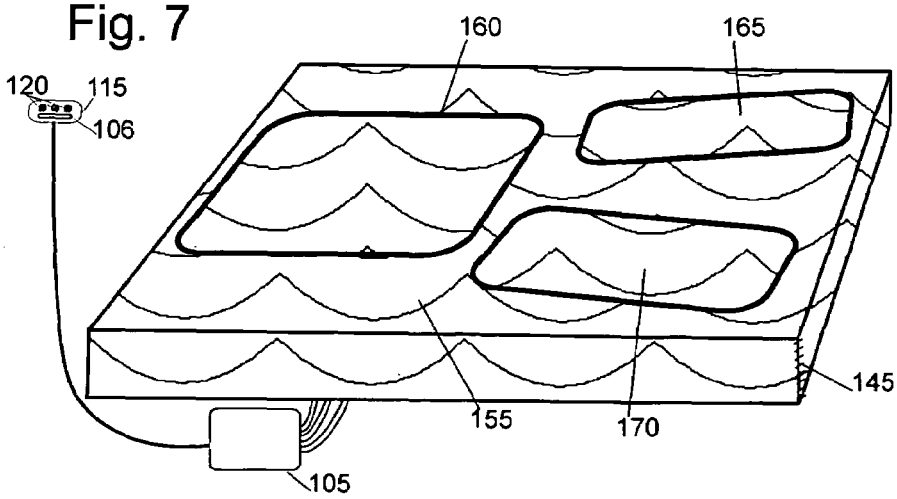
FIG. 7 is a view of the fully assembled unit with the three lids covering the bladder pockets, constructed in accordance with the exemplary embodiments of the present invention.
Figure 8:
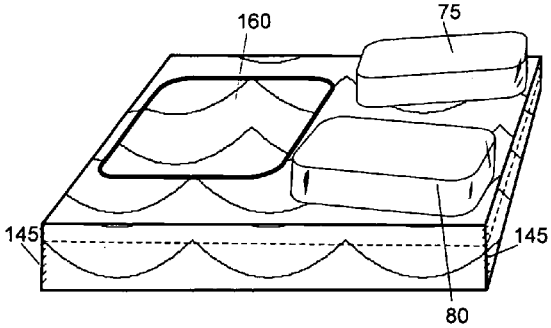
FIG. 8 is a view of the fully assembled unit secured over a mattress with the left and right lower bladders inflated, constructed according to the embodiment of the present invention.
Figure 8A:
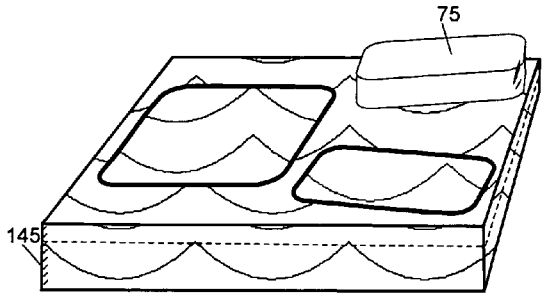
FIG. 8A is a view of the fully assembled unit attached to a mattress with the left lower bladder inflated, constructed in according to the embodiment of the present invention.
Figure 8B:
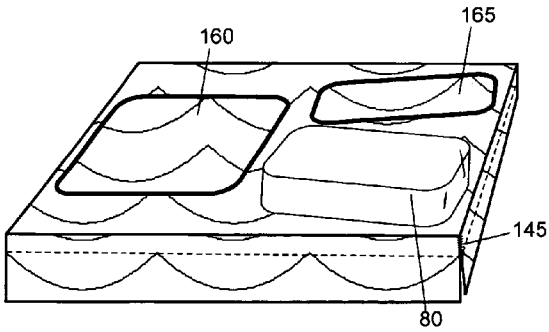
FIG. 8B is a view of fully assembled unit attached to a mattress with the right lower bladder inflated, constructed in according to the embodiment of the present invention.
Figure 8C:
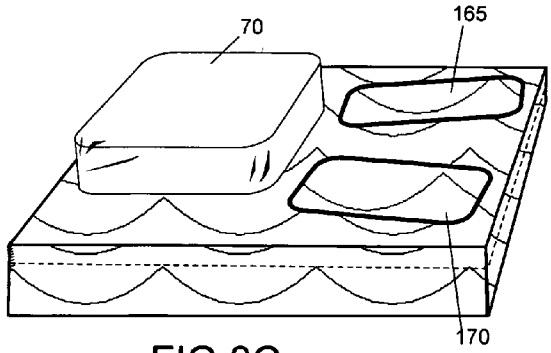
FIG. 8C is a view of fully assembled unit attached to a mattress with the upper half bladder inflated, constructed in according to the embodiment of the present invention.

Referring to FIGS. 6 and 7, these are the different stages of the fully assembled unit, with the top cover FIG. 5 mounted atop bottom unit FIG. 3 or 4 by means of a Velcro lining at the bottom (not shown) to the Velcro on the top four corners of the bottom unit 190, When the top cover FIG. 5 is mounted over the bottom unit, the rectangular full cavities 130,135, 140, settle atop the shallow rectangular craters 20, 25, 30 to form a pocket that houses the bladders 70, 75, and 80. The lids are either sewn to the part of surface area surrounding the windows, configured to be removable or to rest atop the bladders when fully inflated referring to FIG. 8-8C, these are some of the inflatable combination of the unit. these positions can be achieved by utilizing a manually or switch operated pump or by using a wired/wireless remote 115, by entering the a numeric value of the height requirement for the bladders in one, two or the three field on the LCD screen 106, the bladder will inflate automatically to the desired height and shape, the inflation process could be manual or automatic. The system also utilizes electricity or a rechargeable battery (not shown), and an LED indicator (not shown) for the operation. The remote control 115 is used to activate the air pump 105 which releases air through the air outlets of the main engine (not shown) through the tubes 91, 96, 101, into the docked deflated bladders FIG. 3, 70, 75, 80, the bladders emerge vertically through windows 130, 135, 140 of the top cover of FIG. 5 to fully elevate the whole body and allow for sexual intercourse where the left and right legs are in wide spread posture and a second party is utilizing the space between bladders 75 and 80. FIG. 8 will support the legs and thighs of a person lying on the back with the head in the upper half area and allow a second party to utilize the space between 75 and 80 for sex. FIGS. 8A and 8B will support the legs and thighs of a person lying on the back with the head over the right or left lid and allow a second party lying on the side to utilize the space beneath the legs for sex. 8C will support the legs and thigh of a person lying with the head to the lower half or can be utilized as a sitting tool for sex. It should be known that the attachment means for all the loose parts of the unit could be sewing, heat sealing, zipper, Velcro, snaps, Buttons, double-sided tapes, straps of any form of configuration, cloth skirt with elastic, and also that all the fabrics used in the configuration of the unit are removable and washable the system utilized for the unit will also be configured as part of the permanent features of a foam, spring, coil, air mattresses, utilizing bladders that will be embedded directly onto a rectangular shallow crater on the surface area of the mattress, with the tubes routed to the side of the mattress, so that a pump can be attached and detached during inflation and deflation. The attachment could be by means of a zipper attachable to the edges of such foam and extending substantially around the edges or the unit, it could also be sewn or heat welded to the mattress edges with the bladders and other loose parts capable of being removed and replaced and will utilize a detachable lid and bedspread fabrics that are all removable and washable Although a particular exemplary embodiment of the invention has been disclosed in detail for illustrative purposes, it will be recognized to those skilled in the art that variations or modifications of the disclosed brush, including the rearrangement in the configurations of the part, changes in sizes and dimensions, variances in terms of detachability and attach ability is possible. Accordingly, the invention is intended to embrace all such alternatives, modifications and variations as may fall within the spirit and scope of the present invention.

I claim:

1. A mattress pad for elevating various parts of a body to support sex, the mattress pad comprising:

a bottom layer formed with at least three indentations;

at least three bladders separately arranged within the at least three indentations of the bottom layer;

a top fabric cover attached to the bottom layer over the at least three bladders; and at least one air pump connected to the at least three bladders for inflating the at least three bladders.

2. The mattress pad of claim 1, wherein the at least three bladders are each rectangular.

3. The mattress pad of claim 1, wherein the at least three bladders include PVC.

4. The mattress pad of claim 1, wherein the at least three bladders are removably encased in fabric.

5. The mattress pad of claim 1, wherein the top fabric cover is padded.

6. The mattress pad of claim 1, wherein the top fabric cover is padded and is between 1 to 6 inches in thickness.

7. The mattress pad of claim 1, wherein the top fabric cover comprises three cavities and three lids for covering the three cavities, and wherein the at least three bladders are arranged to pass through the cavities during inflation and deflation.

8. The mattress pad of claim 1, wherein the top fabric cover comprises three cavities and three lids, wherein each of the three lids are fastened to at least one edge of at least one of the three cavities, and wherein the at least three bladders are arranged to pass through the cavities during inflation and deflation.

9. The mattress pad of claim 1, wherein the at least three indentations comprise three fortified rectangular shallow craters.

10. The mattress pad of claim 1, wherein:

a first one of the at least three indentations is configured on an upper half section of the bottom layer; and second and third ones of the at least three indentations are configured at an angle relative to a centerline of the bottom layer, on respective left and right sides of the lower part of the bottom layer extending from a mid area toward a feet area.

11. The mattress pad of claim 1, wherein the top fabric cover is configured to cover the top and all four sides of the mattress pad.

12. The mattress pad of claim 1, wherein the top fabric cover comprises an oversized padded fabric configured to extend over the sides of a mattress on which the mattress pad is placed.

13. The mattress pad of claim 1, wherein the bottom layer comprises a layer of foam between 1 and 12 inches in thickness encased in a fabric.

14. The mattress pad of claim 1, wherein the at least three bladders when fully deflated are substantially flush with a top surface of the bottom layer, and thereby the at least three bladders do not protrude substantially from the at least three indentations.

15. The mattress pad of claim 1, wherein the bottom layer comprises a plurality of foam pieces connected with sewn fabric.

16. The mattress pad of claim 1, wherein the mattress pad is configured for fastening on a mattress.

17. The mattress pad of claim 1, further comprising:

a remote control operatively associated with the at least one pump for controlling the operation of the at least one pump to inflate and deflate the at least three bladders; and a pressure regulator connected to the at least one pump for limiting an amount of air provided to the at least three bladders.

18. The mattress pad of claim 1, wherein the at least three bladders comprise at least one of support beams and baffles.

19. The mattress pad of claim 1, further comprising at least one of a massage device and a heating device.

20. The mattress pad of claim 1, wherein the mattress pad is configured to permit adjustment of the positioning of the at least three bladders to suit a user preference.

* * * * *